US005974287A

United States Patent [19]

Kurz et al.

[11] Patent Number: 5,974,287

[45] Date of Patent: Oct. 26, 1999

[54] NON-CONTACTING PHOTORECEPTOR COVER

[75] Inventors: Karl E. Kurz, Rochester; Daniel A. Chiesa, Webster, both of N.Y.

[73] Assignee: Xerox Corporation, Stamford, Conn.

[21] Appl. No.: 09/050,684

[22] Filed: Mar. 30, 1998

[51] Int. Cl.[6] ..... G03G 15/00; G03G 21/18

[52] U.S. Cl. ..... 399/114

[58] Field of Search ..... 399/102, 111, 399/114, 116, 118, 119, 123

[56] References Cited

U.S. PATENT DOCUMENTS

| | | | |
|---|---|---|---|
| 4,462,677 | 7/1984 | Onoda | 399/114 |
| 4,470,689 | 9/1984 | Nomura et al. | 399/114 |
| 4,588,280 | 5/1986 | Ogawa et al. | 399/114 |
| 4,786,938 | 11/1988 | Carter | 355/3 R |
| 5,061,959 | 10/1991 | Kinoshita et al. | 355/210 |
| 5,083,158 | 1/1992 | Kashima et al. | 355/200 |
| 5,095,335 | 3/1992 | Watanabe et al. | 355/210 |
| 5,572,305 | 11/1996 | Hayashi et al. | 399/121 |
| 5,608,498 | 3/1997 | Nagase et al. | 399/130 |
| 5,678,139 | 10/1997 | Nomura et al. | 399/114 |
| 5,697,022 | 12/1997 | Matsuda et al. | 399/102 |
| 5,708,924 | 1/1998 | Shogren et al. | 399/116 |

*Primary Examiner*—Fred L. Braun
*Attorney, Agent, or Firm*—John S. Wagley

[57] ABSTRACT

A cover for protecting from undesired exposure a photoconductive member assembled to the housing of a printing cartridge for use in a printing machine is provided. The housing includes an aperture periphery defining an aperture therein for communication of illumination from an illumination source with the photoconductive member. The cover includes a first portion positionable adjacent the housing, a second portion operably associated with the first portion and at least partially extendible between the illumination source and the photoconductive member for protecting a substantial portion of the photoconductive member from exposure, a third portion operably associated with the second portion, the third portion removably securable to the housing, and a fourth portion operably associated with the third portion. The fourth portion is utilized for removal of the cover. As the third portion is pulled from the housing the third portion is directed along a path spaced from the photoconductive member.

30 Claims, 11 Drawing Sheets

NON-CONTACTING PHOTORECEPTOR COVER

BACKGROUND OF THE INVENTION

This invention relates to electrostatographic reproduction machines, and more particularly to a shield for a photoconductive member for use in an economical and capacity-extendible all-in-one process cartridge for easy adaptive use in a family of compact electrostatographic reproduction machines having different volume capacities and consumable life cycles.

Generally, the process of electrostatographic reproduction, as practiced in electrostatographic reproduction machines, includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred at a transfer station onto a copy sheet fed to such transfer station, and on which the toner particles image is then heated and permanently fused so as to form a "hardcopy" of the original image.

It is well known to provide a number of the elements and components, of an electrostatographic reproduction machine, in the form of a customer or user replaceable unit (CRU). Typically such units are each formed as a cartridge that can be inserted or removed from the machine frame by a customer or user. Reproduction machines such as copiers and printers ordinarily include consumable materials such as toner, volume limiting components such as a waste toner container, and life cycle limiting components such as a photoreceptor and a cleaning device. Because these elements of the copying machine or printer must be replaced frequently, they are more likely to be incorporated into a replaceable cartridge as above.

There are therefore various types and sizes of cartridges, varying from single machine element cartridges such as a toner cartridge, to all-in-one electrostatographic toner image forming and transfer process cartridges. The design, particularly of an all-in-one cartridge can be very costly and complicated by a need to optimize the life cycles of different elements, as well as to integrate all the included elements, while not undermining the image quality. This is particularly true for all-in-one process cartridges to be used in a family of compact electrostatographic reproduction machines having different volume capacities and elements having different life cycles.

There is therefore a need for a quality image producing, economical and capacity-extendible all-in-one process cartridge that is easily adapted for use in various machines in a family of compact electrostatographic reproduction machines having different volume capacities and elements with different life cycles.

In the xerographic process, a photoconductive surface is utilized to attract marking particles. The exposure of the photoconductive surface to prolonged periods of light significantly shorten the useful live of the photoconductive surface. The utilization of copy machines and printers with print cartridges for replacement of a combination of consumable parts including the photoconductive surface and the marking particles requires that the print cartridge be configured so as to expose at least a portion of the photoconductive surface to light so that the photoconductive surface may be in communication with the illuminating source within the printing machine.

The photoconductive surface which is exposed in the print cartridge must be protected from light and contamination during shipment and storage of spare print cartridges. Attempts have been made to protect the photoconductive surface within the printing cartridges during shipment and storage. One such prior attempts at protecting the photoconductive surface is in the form of a cover that wraps all the way around the cartridge.

These prior art wrap around covers are plagued by a series of problems. Since the photoconductive surface needs to be exposed to the illumination source within the printing machine, the cover must be removed before use of the print cartridge. The photoconductive surface is very sensitive to contamination and light and thus the cover preferably should be removed after the print cartridge is installed within the machine. Covers, however, that wrap all the way around the print cartridge are very difficult to remove from the assembly and must be removed prior to the installation of the print cartridge. Thus, the photoconductive surface is often contaminated during installation by, for example, fingers or hands contacting the photoconductive surface during installation of the print cartridge.

Further, the use of covers that wrap all the way around the cartridge often are secured by means of an adhesive, for example, in the form of a glue secured against the print cartridge cover. It becomes very difficult to remove the cover after assembly without having the glue on the cover pass by and contaminate the photoconductive surface. The presence of even a small amount of glue on the photoconductive surface will damage the photoconductive surface and result in unacceptably poor copy quality.

More recently printing cartridges have been provided with an automatic shutter mechanism that exposes the photoconductive surface as the printing cartridge is installed into the printer. Such an automatic shutter mechanism is described in U.S. Pat. No. 5,095,335. The automatic shutter mechanisms are very expensive to fabricate and assemble into the printing cartridge and are prone to mechanical problems related to repeated use. The following disclosures may be relevant to various aspects of the present invention:

U.S. Pat. No. 5,708,924

Patentee: Shogren et al.

Issue Date: Jan. 13, 1998

U.S. Pat. No. 5,697,022

Patentee: Matsuda et al.

Issue Date: Dec. 9, 1997

U.S. Pat. No. 5,678,139

Patentee: Nomura et al.

Issue Date: Oct. 14, 1997

U.S. Pat. No. 5,608,498

Patentee: Nagase et al.

Issue Date: Mar. 4, 1997

U.S. Pat. No. 5,572,305

Patentee: Hayashi et al.

Issue Date: Nov. 5, 1996

U.S. Pat. No. 5,095,335

Patentee: Watanabe, et al.

Issue Date: Mar. 10, 1992

U.S. Pat. No. 5,083,158

Patentee: Kashima et al.

Issue Date: Jan. 21, 1992

U.S. Pat. No. 5,061,959

Patentee: Kinoshita et al.

Issue Date: Oct. 29, 1991

U.S. Pat. No. 4,786,938

Patentee: Carter

Issue Date: Nov. 22, 1988

U.S. patent application Ser. No. 08/971,010

Applicants: Kumar, et al.

Filing Date: Nov. 14, 1997

U.S. Pat. No. 5,708,924 discloses a customer replaceable unit includes a cover and support structure for supporting a photoreceptor belt while it is packaged, shipped and inserted over drive and idler rolls in a machine. It prevents a machine operator from having to handle the belt itself and provides protection from extrinsic damage.

U.S. Pat. No. 5,697,022 discloses a process cartridge detachably mountable to a main assembly of an image forming apparatus including a first frame, a second frame engageable with the first frame, an image bearing member, a process device actable on the image bearing member, an elastic sealing member interposed between the first and second frames engaged with each other, with the elastic sealing member locally compressed by a projection.

U.S. Pat. No. 5,678,139 discloses a process cartridge detachably mountable relative to a main assembly of an image forming apparatus includes an image bearing member, a process device actable on the image bearing member, an elastic device, a receptor for receiving a force against an elastic force of the elastic device in contact with the main assembly when the process cartridge is mounted to the main assembly of the image forming apparatus, where when the process cartridge is to be taken out of the main assembly of the image forming apparatus, the elastic device displaces the process cartridge by the elastic force of the elastic device.

U.S. Pat. No. 5,095,335 discloses an image forming apparatus includes a cartridge detachably mountable to the image forming apparatus, the cartridge including a movable image bearing member, a charging member having a contact member for contacting to the image bearing member in the cartridge to charge the image bearing member, the contact member is mounted in the image bearing member, a supporting member for supporting the contact member for movement between a first position where the contact member is contacted to the image bearing member and a second position where the contact member is away from the image bearing member, a member actable on the supporting member in accordance with mounting or dismounting of the cartridge relative to the image forming apparatus, wherein upon dismounting of the cartridge, the contact member is moved from the first position to the second position.

U.S. Pat. No. 5,608,498 discloses an image forming apparatus in which each of charging devices, image exposure devices and developing devices is provided in plural sets corresponding in number to plural different color components and placed in such an arrangement that the plural different color component toner images are superimposed on the image carrying member during a single rotation of the image carrying member, all of the plural image exposure means, and the image carrying member are constructed in a single body and is shiftable together in a direction perpendicular to the rotation axis of the image carrying member from or to the working position of the image carrying member.

U.S. Pat. No. 5,572,305 discloses an image forming apparatus using a transfer unit of a roller transfer method, the contact between the transfer unit and a photoreceptor drum can easily be canceled. The transfer unit is brought into contact with the photoreceptor drum by supplying an upward pushing force to a supporting member of the transfer unit, and a lever engaging with the supporting member to push down the supporting member is provided to connect with a front cover of the apparatus body. The transfer roller, the pre-transfer roller for feeding a sheet to the photoreceptor drum and driving force transmitting gears provided therebetween are supported by the same member to fix their relative positions so that the driving force is constantly transmitted from the transfer roller to the pre-transfer roller.

U.S. Pat. No. 5,095,335 discloses an image forming apparatus includes a cartridge detachably mountable to the image forming apparatus, the cartridge including a movable image bearing member, a charging member having a contact member for contacting to the image bearing member in the cartridge to charge the image bearing member, the contact member is mounted in the image bearing member, a supporting member for supporting the contact member for movement between a first position where the contact member is contacted to the image bearing member and a second position lo where the contact member is away from the image bearing member, a member actable on the supporting member in accordance with mounting or dismounting of the cartridge relative to the image forming apparatus, wherein upon dismounting of the cartridge, the contact member is moved from the first position to the second position.

U.S. Pat. No. 5,083,158 discloses a photoconductive cartridge removably mounted on a photographic recording apparatus and including a photoconductive body, a casing having an opening for exposure of the photoconductive body to an outside of the casing, and a shutter having a closed position in which the opening is closed by the shutter and an open position in which the opening is open. The photoconductive cartridge further includes a locking device having a first engaging member movable with the shutter, a second engaging member having a first position in which the second engaging member engages the first engaging member to thereby prevent a movement of the first engaging member and a movement of the shutter from the closed position to the open position, and a second position in which the second engaging member is released from the first engaging member, and a biasing device for biasing the second engaging member toward the first position.

U.S. Pat. No. 5,061,959 discloses a photographic recording apparatus is provided having a housing body, and a process cartridge unit including a photoconductive drum and a developing device and which is removably mounted on the housing body. The cartridge unit includes a first and a second frame which are pivotable about a rotation axis of the drum relative to each other, and a biasing member for biasing the two frames to thereby hold the frames in a first relative angular position. The housing body includes a portion for holding the cartridge unit such that the two frames are held in a second relative angular position, which is established by pivoting the two frames from the first relative angular position against a biasing action of the biasing member. The first and second frames each having holes or openings that are initially misaligned, cooperate in an overlapping fashion to provide at least one opening through which a portion of the drum is exposed outside the frames, when the frames are placed in the second relative angular position. Each opening is closed when the frames are placed in the first relative angular position.

U.S. Pat. No. 4,786,938 discloses a process unit which can be removably mounted in a main assembly of an electrostatographic copying machine has a housing enclosing an imaging member and, optionally, other processing means such as a development device, a cleaner, and a charge corotron. The transfer corotron, for transferring a toner image from the photoreceptor to a copy sheet is preferably incorporated in the cassette housing. An aperture is present in the housing adjacent corotron so that a copy sheet can enter the unit to have an image transferred thereto from the photoreceptor. A simple resilient cover flap is provided over the aperture which protects the imaging member from contamination, physical damage, and light exposure when the cassette is removed from the main assembly of the copies. The flap is readily displaced as an entering copy sheet bears against it, thus enabling a copy sheet to pass. As the trail edge of the copy sheet leaves the aperture the resilient flap reverts to its former position in which it closes the aperture until the arrival of a subsequent copy sheet. Instead of a resilient flap the cover may be formed by a brush.

U.S. patent application Ser. No. 08/971,010 discloses a supporting apparatus for supporting a photoconductive member within the housing of a printing cartridge for use in a printing machine. The supporting apparatus includes a body, a connecting feature and a supporting feature. The connecting feature is connected to the body for quick and removable connection to the housing. The supporting feature is connected to the body cooperating with the body for rotatably supporting the photoconductive member within the housing.

SUMMARY OF THE INVENTION

In accordance with one aspect of the present invention, there is provided a cover for protecting from undesired exposure a photoconductive member assembled to the housing of a printing cartridge for use in a printing machine. The housing includes an aperture periphery defining an aperture therein for communication of illumination from an illumination source with the photoconductive member. The cover includes a first portion positionable adjacent the housing, a second portion operably associated with the first portion and at least partially extendible between the illumination source and the photoconductive member for protecting a substantial portion of the photoconductive member from exposure, a third portion operably associated with the second portion, the third portion removably securable to the housing, and a fourth portion operably associated with the third portion. The fourth portion is utilized for removal of the cover. As the third portion is pulled from the housing the third portion is directed along a path spaced from the photoconductive member.

In accordance with another aspect of the present invention, there is provided a printing cartridge for use in a printing machine for applying developer material onto a latent image to form a developed image. The printing cartridge includes a housing, defining an aperture therein and a photoconductive member operably connected to the housing. The printing cartridge also includes a cover for protecting from exposure the photoconductive member. The cover includes a first portion positioned adjacent the housing and a second portion operably associated with the first portion and at least partially extended between the illumination source and the photoconductive member for protecting a substantial portion of the photoconductive member from exposure. The cover also includes a third portion operably associated with the second portion. The third portion is removably secured to the housing. The cover also includes a fourth portion operably associated with the third portion. The fourth portion is used to remove the cover. As the third portion is pulled from the housing, the third portion is directed along a path spaced from the photoconductive member.

In accordance with yet another aspect of the present invention, there is provided an electrophotographic printing machine of the type including a printing cartridge for applying developer material onto a latent image to form a developed image. The printing cartridge includes a housing, defining an aperture therein and a photoconductive member operably connected to the housing. The printing cartridge also includes a cover for protecting from exposure the photoconductive member. The cover includes a first portion positioned adjacent the housing and a second portion operably associated with the first portion and at least partially extended between the illumination source and the photoconductive member for protecting a substantial portion of the photoconductive member from exposure. The cover also includes a third portion operably associated with the second portion. The third portion is removably secured to the housing. The cover also includes a fourth portion operably associated with the third portion. The fourth portion is used to remove the cover. As the third portion is pulled from the housing, the third portion is directed along a path spaced from the photoconductive member.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 10:
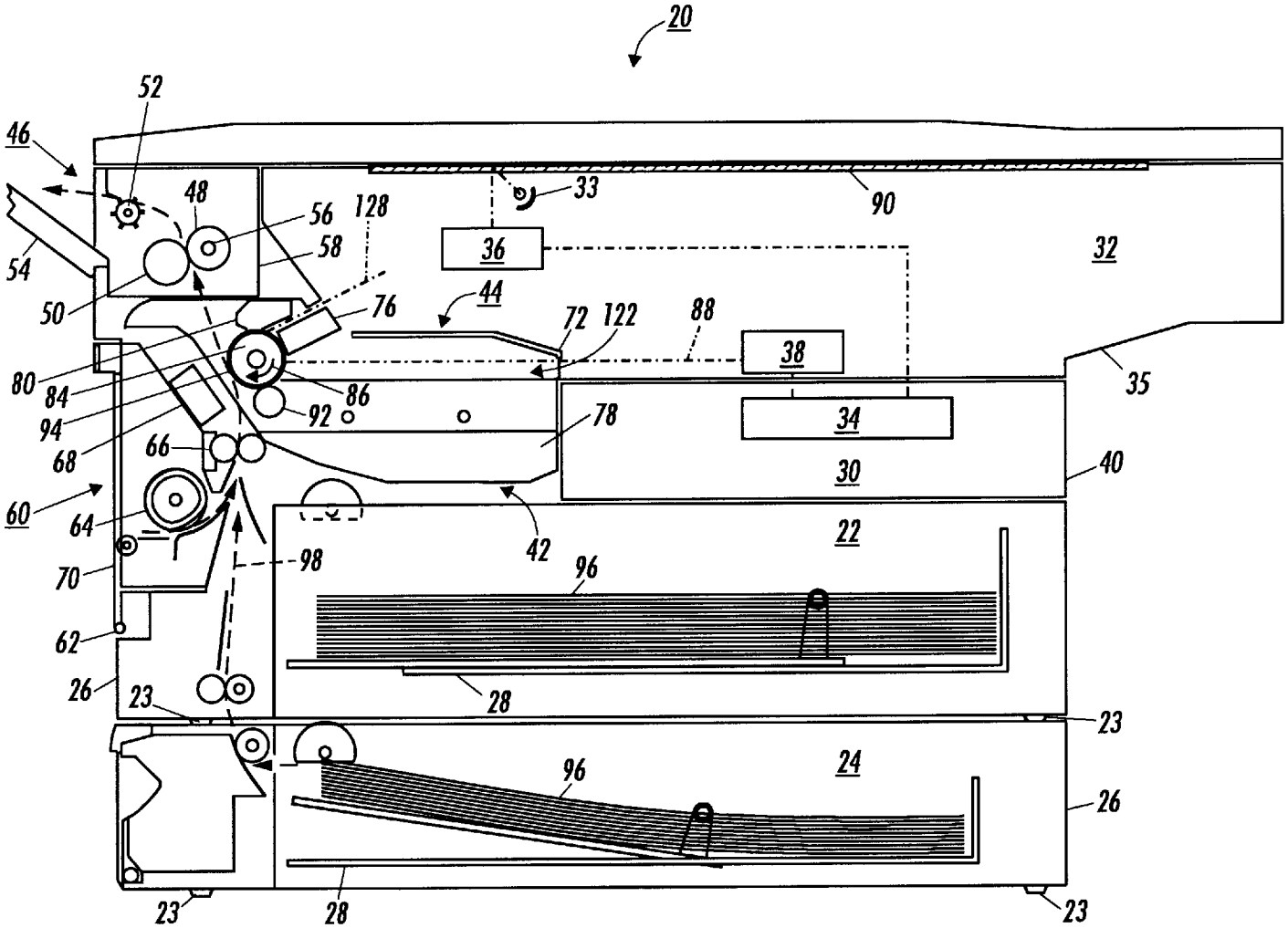
FIG. 10 is a front vertical illustration of an exemplary compact electrostatographic reproduction machine comprising separately framed mutually aligning modules in accordance with the present invention.
Figure 11:
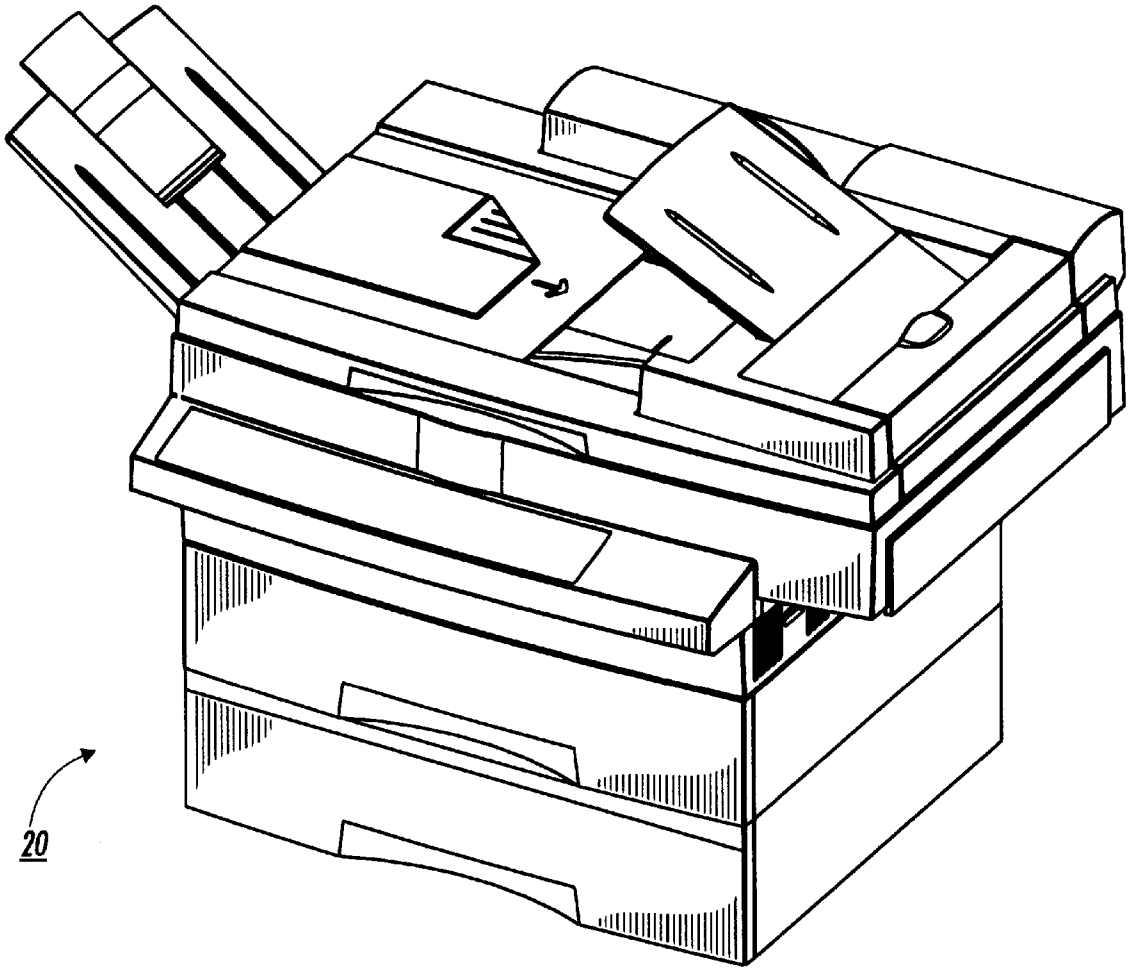
FIG. 11 is a perspective view of the machine of FIG. 10.

Referring now to FIG. 10, there is illustrated a frameless exemplary compact electrostatographic reproduction machine 20 comprising separately framed mutually aligning modules according to the present invention. The compact machine 20 is frameless, meaning that it does not have a separate machine frame to which electrostatographic process subsystems are assembled, aligned to the frame, and then aligned relative to one another as is typically the case in conventional machines. Instead, the architecture of the compact machine 20 is comprised of a number of individually framed, and mutually aligning machine modules that variously include pre-aligned electrostatographic active process subsystems.

As shown, the frameless machine 20 comprises at least a framed copy sheet input module (CIM) 22. Preferably, the machine 20 comprises a pair of copy sheet input modules, a main or primary module the CIM 22, and an auxiliary module the (ACIM) 24, each of which has a set of legs 23 that can support the machine 20 on a surface, therefore suitably enabling each CIM 22, 24 to form a base of the machine 20. As also shown, each copy sheet input module (CIM, ACIM) includes a module frame 26 and a copy sheet stacking and lifting cassette tray assembly 28 that is slidably movable in and out relative to the module frame 26. When as preferred here, the machine 20 includes two copy sheet input modules, the very base module is considered the auxiliary module (the ACIM), and the top module which mounts and mutually aligns against the base module is considered the primary module (the CIM).

The machine 20 next comprises a framed electronic control and power supply (ECS/PS) module 30, that as shown mounts onto, and is mutually aligned against the CIM 22 (which preferably is the top or only copy sheet input module). A framed latent image forming imager module 32 then mounts over and is mutually aligned against the ECS/PS module. The ECS/PS module 30 includes all controls and power supplies (not shown) for all the modules and processes of the machine 20. It also includes an image processing pipeline unit (IPP) 34 for managing and processing raw digitized images from a Raster Input Scanner (RIS) 36, and generating processed digitized images for a Raster Output Scanner (ROS) 38. The ECS/PS module 30 also includes harnessless interconnect boards and inter-module connectors (not shown), that provide all power and logic paths to the rest of the machine modules. An interconnect board (PWB) (not shown) connects the ECS controller and power supply boards (not shown) to the inter-module connectors, as well as locates all of the connectors to the other modules in such a manner that their mating connectors would automatically plug into the ECS/PS module during the final assembly of the machine 20. Importantly, the ECS/PS module 30 includes a module frame 40 to which the active components of the module as above are mounted, and which forms a covered portion of the machine 20, as well as locates, mutually aligns, and mounts to adjacent framed modules, such as the CIM 22 and the imager module 32.

The framed copy sheet input modules 22, 24, the ECS/PS module 30, and the imager module 32, as mounted above, define a cavity 42. The machine 20 importantly includes a customer replaceable, all-in-one CRU or process cartridge module 44 that is insertably and removably mounted within the cavity 42, and in which it is mutually aligned with, and operatively connected to, the framed CIM, ECS/PS and imager modules 22, 30, 32.

As further shown, the machine 20 includes a framed fuser module 46, that is mounted above the process cartridge module 44, as well as adjacent an end of the imager module 32. The fuser module 46 comprises a pair of fuser rolls 48, 50, and at least an exit roll 52 for moving an image carrying sheet through, and out of, the fuser module 46 into an output or exit tray 54. The fuser module also includes a heater lamp 56, temperature sensing means (not shown), paper path handling baffles (not shown), and a module frame 58 to which the active components of the module, as above, are mounted, and which forms a covered portion of the machine 20, as well as locates, mutually aligns, and mounts to adjacent framed modules, such as the imager module 32 and the process cartridge module 44.

The machine then includes an active component framed door module 60 that is mounted pivotably at pivot point 62 to an end of the CIM 22. The door module 60 as mounted, is pivotable from a substantially closed vertical position into an open near-horizontal position in order to provide access to the process cartridge module 44, as well as for jam clearance of jammed sheets being fed from the CIM 22. The door module 60 comprises active components including a bypass feeder assembly 64, sheet registration rolls 66, toner image transfer and detack devices 68, and the fused image output or exit tray 54. The door module 60 also includes drive coupling components and electrical connectors (not shown), and importantly, a module frame 70 to which the active components of the module as above are mounted, and which forms a covered portion of the machine 20, as well as, locates, mutually aligns, and mounts to adjacent framed modules, such as the CIM 22, the process cartridge module 44, and the fuser module 46.

More specifically, the machine 20 is a desktop digital copier, and each of the modules 22, 24, 30, 32, 44, 48, 60, is a high level assembly comprising a self-containing frame and active electrostatographic process components specified for sourcing, and enabled as a complete and shippable product. It is believed that some existing digital and light lens reproduction machines may contain selective electrostatographic modules that are partitioned for mounting to a machine frame, and in such a manner that they could be designed and manufactured by a supplier. However, there are no known such machines that have no separate machine frame but are comprised of framed modules that are each designed and supplied as self-standing, specable (i.e. separately specified with interface inputs and outputs), testable, and shippable module units, and that are specifically crafted and partitioned for enabling all of the critical electrostatographic functions upon a simple assembly. A unique advantage of the machine 20 of the present invention as such is that its self-standing, specable, testable, and shippable module units specifically allow for high level sourcing to a small set of module-specific skilled production suppliers. Such high level sourcing greatly optimizes the quality, the total cost, and the time of delivering of the final product, the machine 20.

Referring now to FIGS. 1–6, the CRU or process cartridge module 44 generally comprises a module housing subassembly 72, a photoreceptor subassembly 74, a charging subassembly 76, a developer subassembly 78 including a source of fresh developer material, a cleaning subassembly 80 for removing residual toner as waste toner from a surface of the photoreceptor, and a waste toner sump subassembly 82 for storing waste toner. The module housing subassembly 72 of the CRU or process cartridge module 44 importantly provides and includes supporting, locating and aligning structures, as well as driving components for the process cartridge module 44.

Still referring to FIG. 1, operation of an imaging cycle of the machine 20 using the all-in-one process cartridge module 44 generally, can be briefly described as follows. Initially, a photoreceptor in the form of a photoconductive drum 84 of the customer replaceable unit (CRU) or process cartridge module 44, rotating in the direction of the arrow 86, is charged by the charging subassembly 76. The charged portion of the drum is then transported to an imaging/exposing light 88 from the ROS 38 which forms a latent image on the drum 84, corresponding to an image of a document positioned on a platen 90, via the imager module 32. It will also be understood that the imager module 32 can easily be changed from a digital scanning module to a light lens imaging module.

The portion of the drum 84 bearing a latent image is then rotated to the developer subassembly 78 where the latent image is developed with developer material such as with charged single component magnetic toner using a magnetic developer roller 92 of the process cartridge module 44. The developed image on the drum 84 is then rotated to a near vertical transfer point 94 where the toner image is transferred to a copy sheet substrate 96 fed from the CIM 22 or ACIM 22 along a copy sheet or substrate path 98. In this case, the detack device 68 of the door module 60 is provided for charging the back of the copy sheet substrate (not shown) at the transfer point 94, in order to attract the charged toner image from the photoconductive drum 84 onto the copy sheet substrate.

The copy sheet substrate with the transferred toner image thereon, is then directed to the fuser module 46, where the heated fuser roll 48 and pressure roll 50 rotatably cooperate to heat, fuse and fix the toner image onto the copy sheet substrate. The copy sheet substrate then, as is well known, may be selectively transported to the output tray 54 or to another post-fusing operation.

The portion of the drum 84 from which the developed toner image was transferred is then advanced to the cleaning subassembly 80 where residual toner and residual charge on the drum 84 are removed therefrom. The imaging cycle of the machine 20 using the drum 84 can then be repeated for forming and transferring another toner image as the cleaned portion again comes under the charging subassembly 76.

The detailed and specific advantageous aspects of the structure and operation of the all-in-one CRU or process cartridge module 44, will now be described with particular reference to FIGS. 1 to 6. As shown, the all-in-one CRU or process cartridge module 44, generally includes six subassemblies comprising the module housing subassembly 72 (FIG. 2); the cleaning subassembly 80; the photoreceptor subassembly 74; the charging subassembly 76; the developer subassembly 78 (FIG. 3); and the waste toner sump subassembly 82. Generally, the function of the all-in-one CRU or process cartridge module 44 in the machine 20 is to electrostatically form a latent image, develop such latent image into a toner image through toner development, and transfer the toner image unfused onto a printing medium, such as a sheet of paper. The CRU or process cartridge module is left-side accessible to an operator facing the CIM 22 by opening the door module 60 (FIG. 1). Once the door module is opened, an operator or customer can remove or insert the CRU or process cartridge module 44 with one hand.

Figure 1:
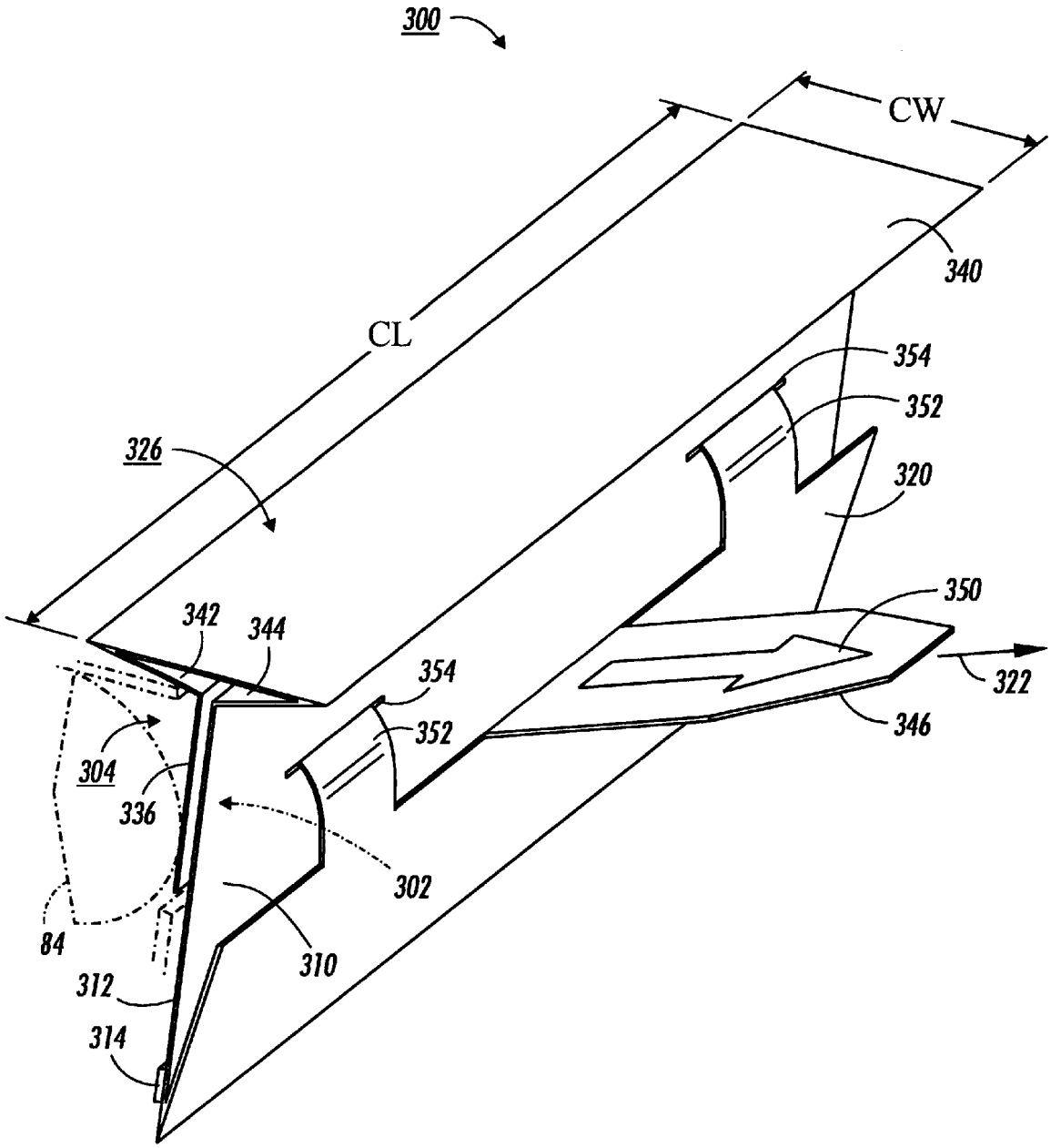
FIG. 1 is a perspective view of a photoreceptor cover according to the present invention.
Figure 2:
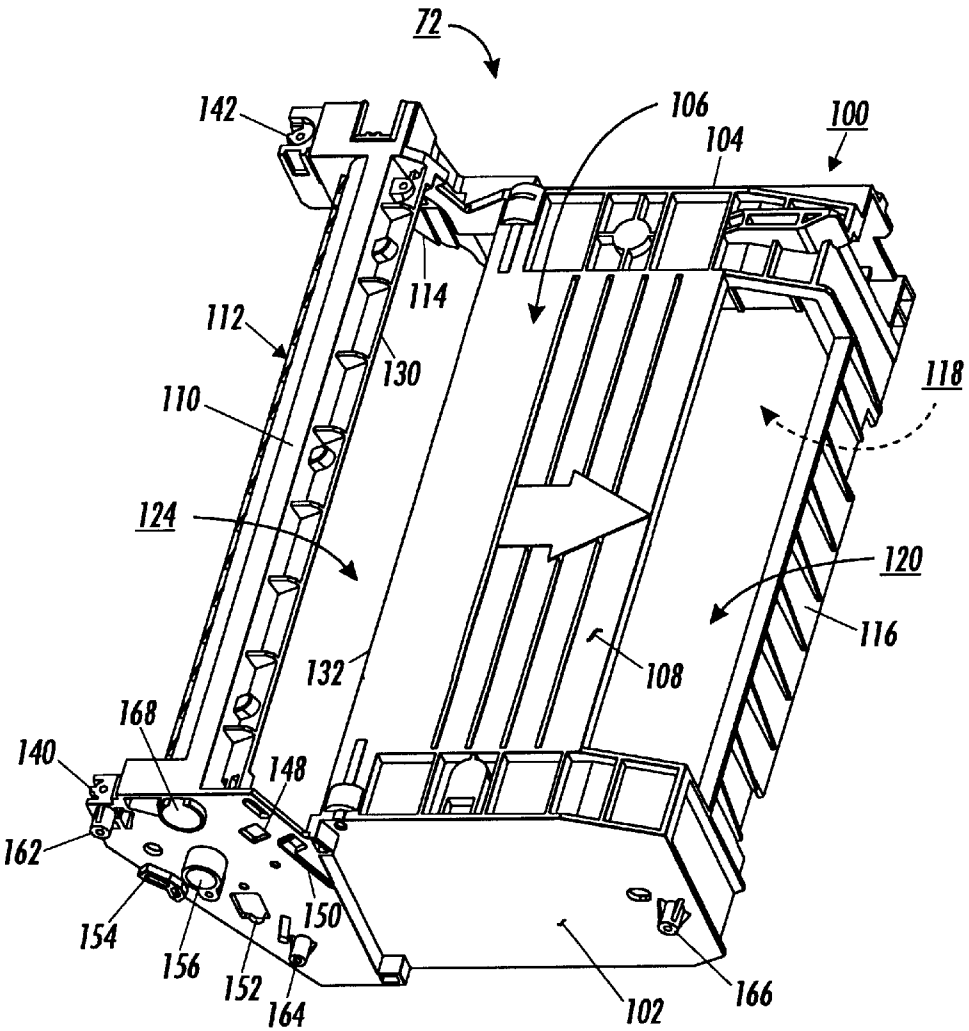
FIG. 2 is a top perspective view of the module housing of the CRU or process cartridge module of the machine of FIG. 1.
Figure 3:
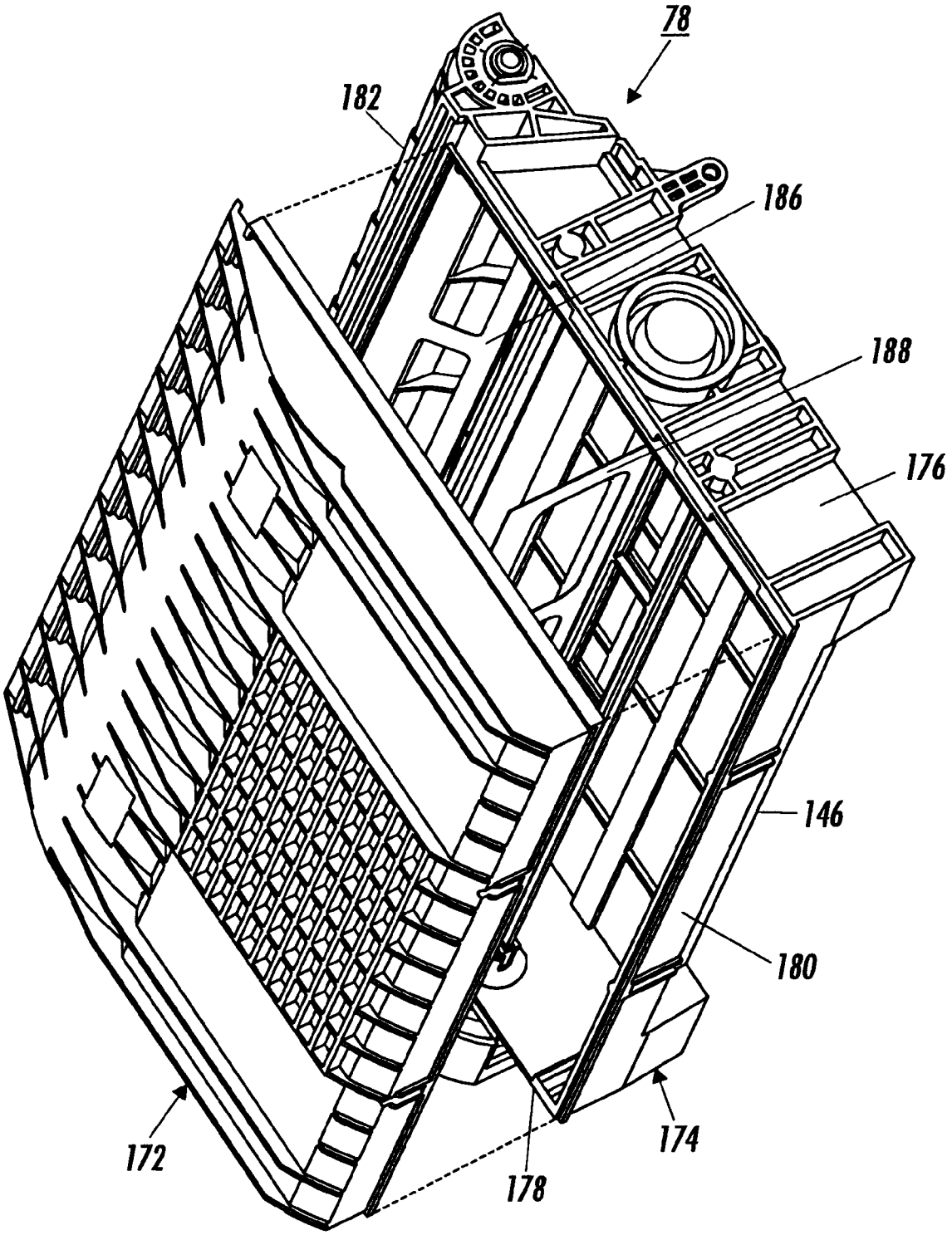
FIG. 3 is a bottom perspective view of the developer subassembly of the CRU or process cartridge module of the machine of FIG. 1 with the bottom of the developer housing unattached.

Referring now to FIGS. 1-6, the module housing subassembly 72 is illustrated (FIG. 2). As shown, it comprises a generally rectangular and inverted trough shaped module housing 100 having a first side wall 102, a second and opposite side wall 104, a top wall 106 including a substantially horizontal portion 108 and a nearly vertical portion 110 defining a raised rear end 112 (rear as considered relative to the process cartridge 44 being inserted into the cavity 42). There is no rear wall, thus resulting in an open rear end 114 for mounting the photoreceptor subassembly 74. The trough shaped module housing also includes a front end wall 116 that connects at an angle to the top wall 106. The trough shaped module housing 100 of course, has no bottom wall, and hence as inverted, it defines a trough region 118 that is wide open for assembling the developer subassembly 78 (FIG. 3). The top wall 106 and the front end wall 116 each include a first cutout 120 formed through their adjoining corner for partially defining a first light path 122 (FIG. 1) for the exposure light 88 from the ROS 38 of the imager module 32. The top wall 106 also includes a second cutout 124 formed thereinto at the adjoining angle between the horizontal 108 and near vertical 110 portions thereof for mounting the charging subassembly 76 (FIG. 5), and for partially defining a second light path 126 (FIGS. 1 and 6) for an erase light 128 being focused into the photoreceptor area at the raised rear end 112 of the module housing 100.

Importantly, the module housing 100 includes two top wall crosssectional surfaces 130, 132 defining the second cutout 124, and one 130, of these cross-sectional wall surfaces, has a desired angle 134 (relative to the photoreceptor surface) for mounting and setting a cleaning blade 138 (FIG. 6) of the cleaning subassembly 80. Attachment members 140, 142 are provided at the raised rear end 112 and extending from the first and second side walls 102, 104 respectively, for attaching a module handle 144 to the module housing 100.

As pointed out above, the module housing 100 is the main structure of the all-in-one CRU or process cartridge module 44, and importantly supports all other subassemblies (cleaning subassembly 80, charging subassembly 76, developer subassembly 78, and sump subassembly 82) of the all-in-one process cartridge module 44. As such, it is designed for withstanding stresses due to various dynamic forces of the subassemblies, for example, for providing a required re-action force to the developer subassembly 78. Because it is located just about 3 mm below the fuser module 46, it is therefore made of a plastic material suitable for withstanding relatively high heat generated from the fuser module. Mounts (not shown) to the developer subassembly within the trough portion of the module housing subassembly are located such that the top wall 106 of the module housing defines a desired spacing comprising the first light path 122 between it and the top 146 of the developer subassembly. Similarly, the raised rear end 112 of the top wall 106 of the module housing is also such as to define a desired spacing between the charging subassembly 76 and the photoreceptor or drum 84, when both are mounted to the raised rear end 112 of the module housing 100. Additionally, the module housing 100 provides rigidity and support to the entire process cartridge module 44, and upon assembly mutually self-aligns the CRU or process cartridge module 44 relative to abutting modules such as the CIM 22, and ECS/PS module 30.

Figure 5:
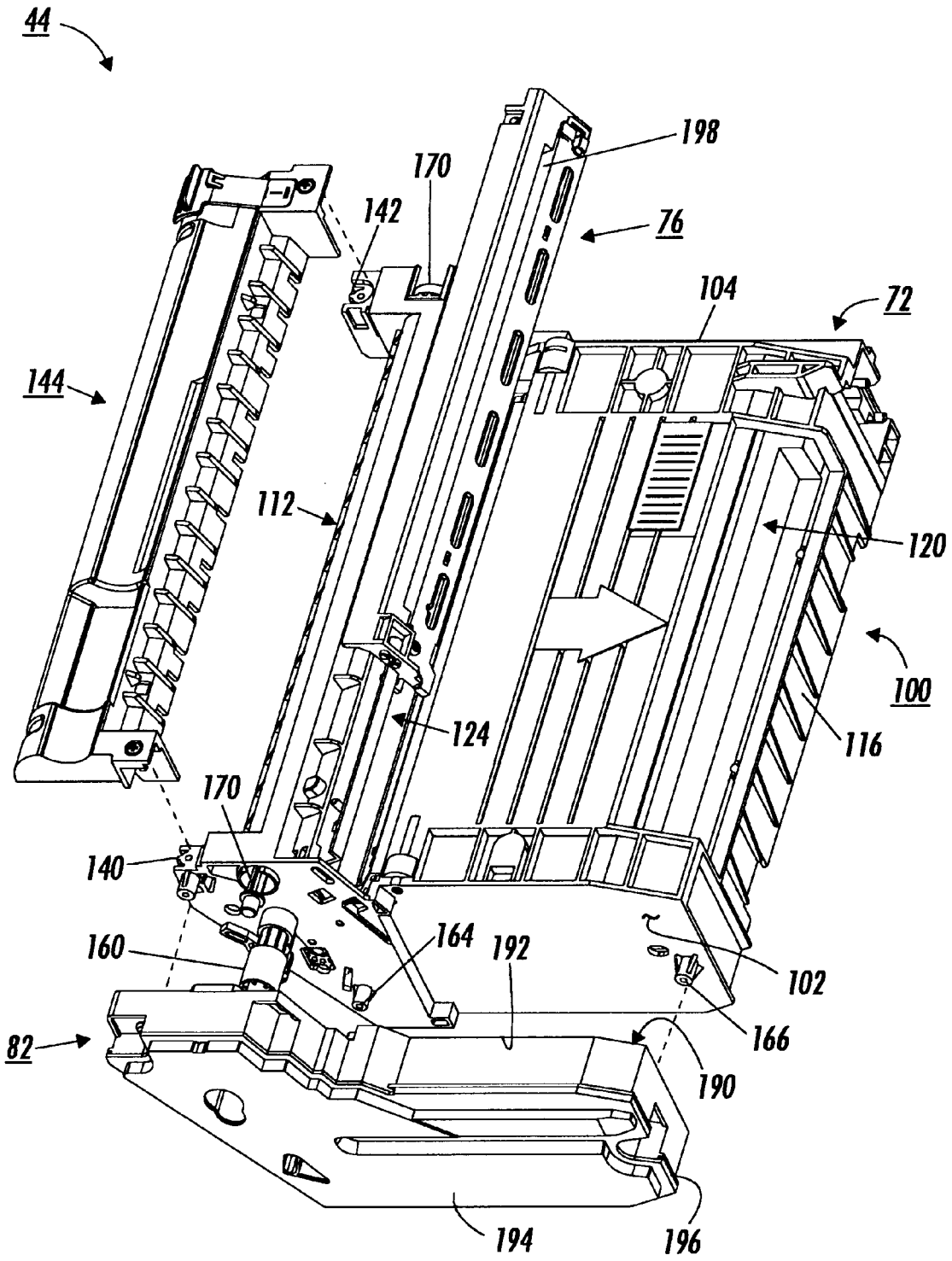
FIG. 5 is an exploded view of the various subassemblies of the CRU or process cartridge module of the machine of FIG. 1.

Referring in particular to FIG. 2, the first side wall 102 includes electrical connectors 148, 150 for supplying power from the ECS/PS module 30 (FIG. 1) via the sump subassembly 82 to the charging subassembly 76. It also includes an electrical connector 152 for supplying an electrical bias to the developer subassembly 78, as well as an alignment member 154 for aligning the detack device 68 (FIG. 1) to the photoreceptor. As also shown, the first side wall 102 further includes an apertured retainer device 156 for receiving an electrical grounding pin 160 for the photoreceptor 84. Importantly, the first side wall 102 further includes mounting members 162, 164, 166 for mounting the sump subassembly 82 to the module housing 100, and an opening for mounting an auger 170 of the cleaning subassembly 80 (FIGS. 1 and 5). The opening 168 also passes waste toner received from the photoreceptor 84 in the raised rear end 112, into the sump assembly 82, when mounted as above.

Referring now to FIG. 3, the developer subassembly 78 of the process cartridge module 44 is illustrated with an expandable bottom member 172 unattached in order to reveal the inside of the developer subassembly. As shown, the developer subassembly 78 comprises a generally rectangular developer housing 174 having the bottom member 172, the top 146, a first side 176, a second and opposite side 178, a front end 180 (relative to cartridge insertion), and a rear end 182. The developer housing 174 is for containing developer material, such as, single component magnetic toner (not shown), and it additionally houses the magnetic developer roll 92 (FIG. 6, a development bias application device 184, and a pair of developer material or toner agitators 186,188.

Figure 4:
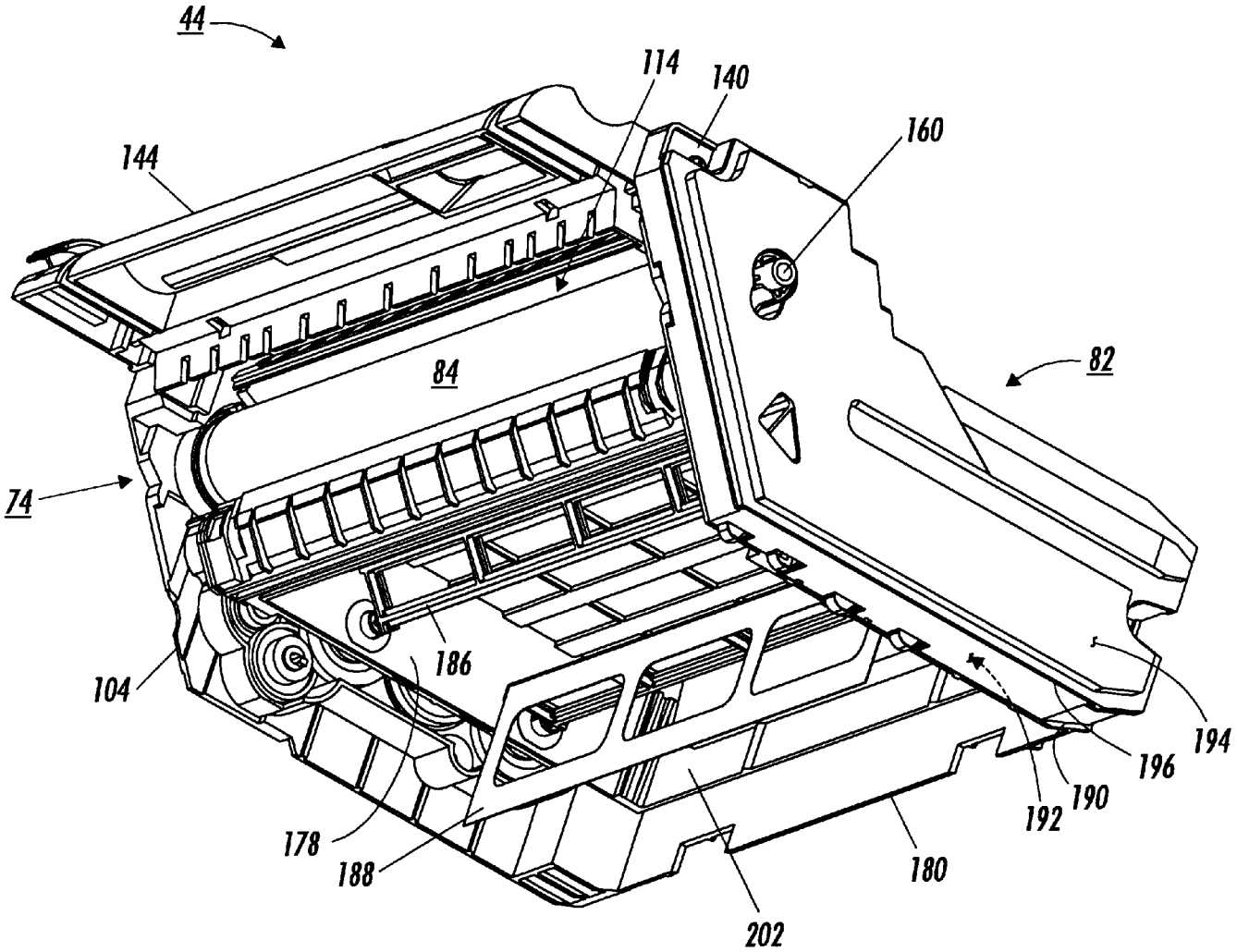
FIG. 4 is an open bottom perspective view of the CRU or process cartridge module of the machine of FIG. 1.

As shown in FIG. 4, the developer subassembly 78 is mounted to the module housing 100, and inside the trough region 118. With the bottom member 172 of the developer housing removed (for illustration purposes only), the agitators 186, 188 can clearly be seen. Also shown in FIG. 4 are the photoreceptor or drum 84 mounted within the raised rear end 112 of the module housing 100, as well as, the module handle 144 attached to the side walls 102, 104 at the raised rear end 112. The whole sump subassembly 82 is further shown with an outside surface 190 of its inside wall 192, mounted to the first side wall 102 of the module housing 100. The outside surface 194 of the outside wall 196 of the sump assembly is also clearly visible. The inside wall 192 and outside wall 196 partially define the sump cavity (not shown) for containing received waste toner, as above.

Referring now to FIG. 5, there is presented an exploded perspective view of the various subassemblies, as above, of the CRU or process cartridge module 44. As shown, the module handle 144 is attachable to mounting members 140, 142 at the raised rear end 112 of the module housing 100, and the sump subassembly 82 is mountable to the first side wall 102 of the cartridge housing. The developer subassembly 78 is mounted within the trough region 118 of the module housing 100, and is partially visible through the first cutout 120. Advantageously, the developer subassembly fits into the trough region 118 such that the top 146 (FIG. 6) of the developer subassembly and the inside of the top wall 106 of the module housing define the first light path 122 for the exposure light 88 from the ROS 38 (FIG. 1).

As also shown, the charging subassembly 76 is mountable, at the second cutout 124, to the module housing 100, and includes a slit 198, through the charging subassembly, that defines part of the second light path 126 for the erase light 128 to pass to the photoreceptor 84.

Figure 6:
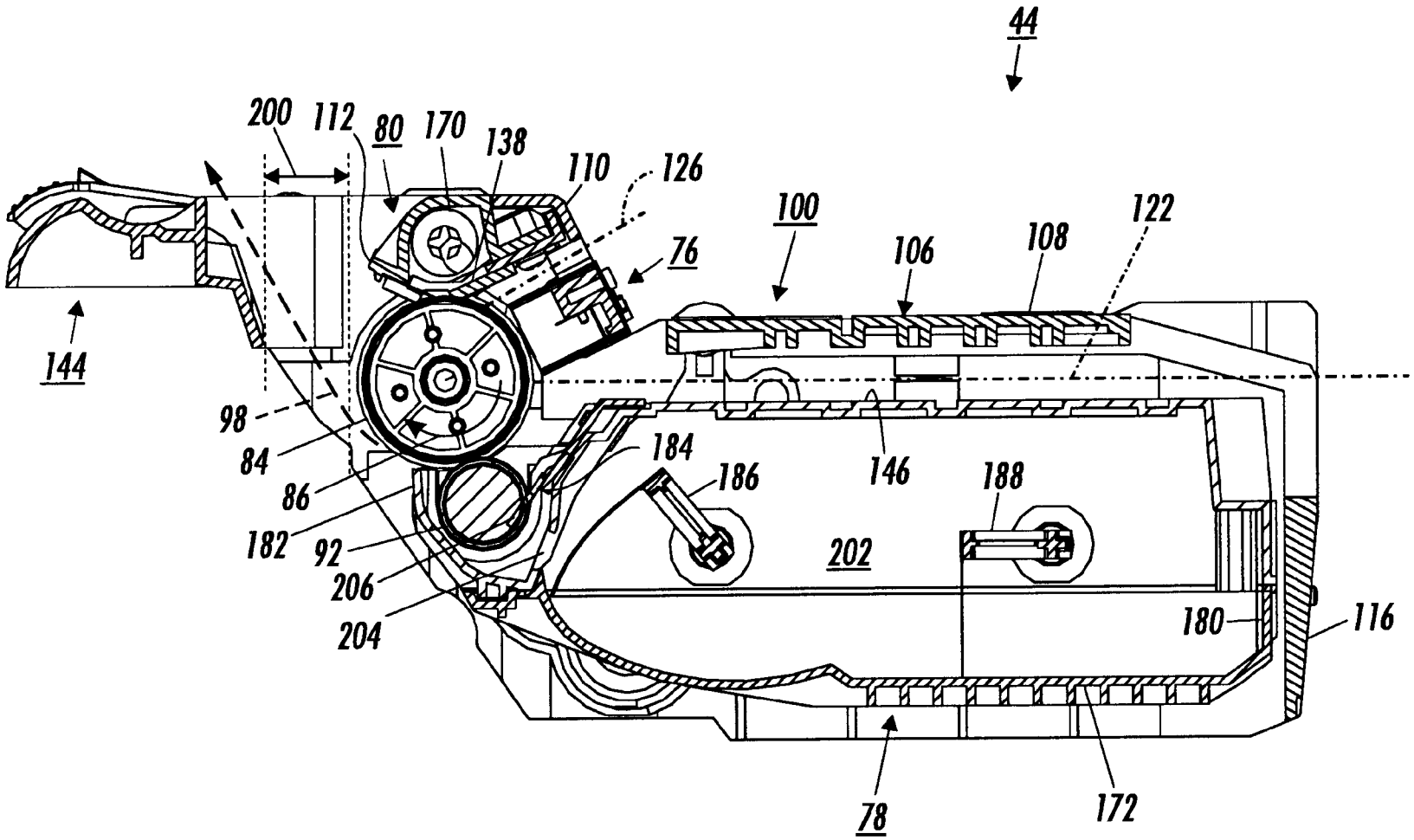
FIG. 6 is a vertical section (front-to-back) of the CRU or process cartridge module of the machine of FIG. 1.

Referring next to FIG. 6, a vertical (rear-to-back) section of the CRU or process cartridge module 44 as viewed along the plane 6—6 of FIG. 5 is illustrated. As shown, the developer subassembly 78 is mounted within the trough region 118 of the module housing subassembly 72 as defined in part by the front end wall 116, the second side wall 104, and the top wall 106 of the module housing subassembly. The module handle 144 as attached to mounting members 140, 142, (only one of which is visible), forms a portion of the sheet or paper path 98 of the machine 20 (FIG. 1) by being spaced a distance 200 from photoreceptor 84 in the raised rear end 112 of the module housing 100. The photoreceptor or drum 84 is mounted to the side walls 102, (only one of which is visible), and as shown is located within the raised rear end 112 and is rotatable in the direction of the arrow 86. The charging subassembly 76 is mounted within the second cutout 124 in the top wall 106 and includes the slit 198 defining part of the second light path 126 for erase light 128 to pass to the photoreceptor 84. Upstream of the charging subassembly 76, the cleaning subassembly 80, including the cleaning blade 138 and the waste toner removing auger 170, is mounted within the raised rear end 112, and into cleaning contact with the photoreceptor 84. As further shown, the top wall 106 of the module housing 100 is spaced from the top 146 of the developer subassembly 78, thus defining the part of first light path 122 for the exposure light 88 from the ROS 38 (FIG. 1). The first light path 122 is located so as to be incident onto the photoreceptor at a point downstream of the charging subassembly 76.

The front 180, top 146, and bottom member 172 of the developer subassembly define a chamber 202, having an opening 204, for containing developer material (not shown). The first and second agitators 186, 188 are shown within the chamber 202 for mixing and moving developer material towards the opening 204. The developer material biasing device 184 and a charge trim and metering blade 206 are mounted at the opening 204. As also shown, the magnetic developer roll 92 is mounted at the opening 204 for receiving charged and metered developer material from such opening, and for transporting such developer material into a development relationship with the photoreceptor 84.

Figure 8:
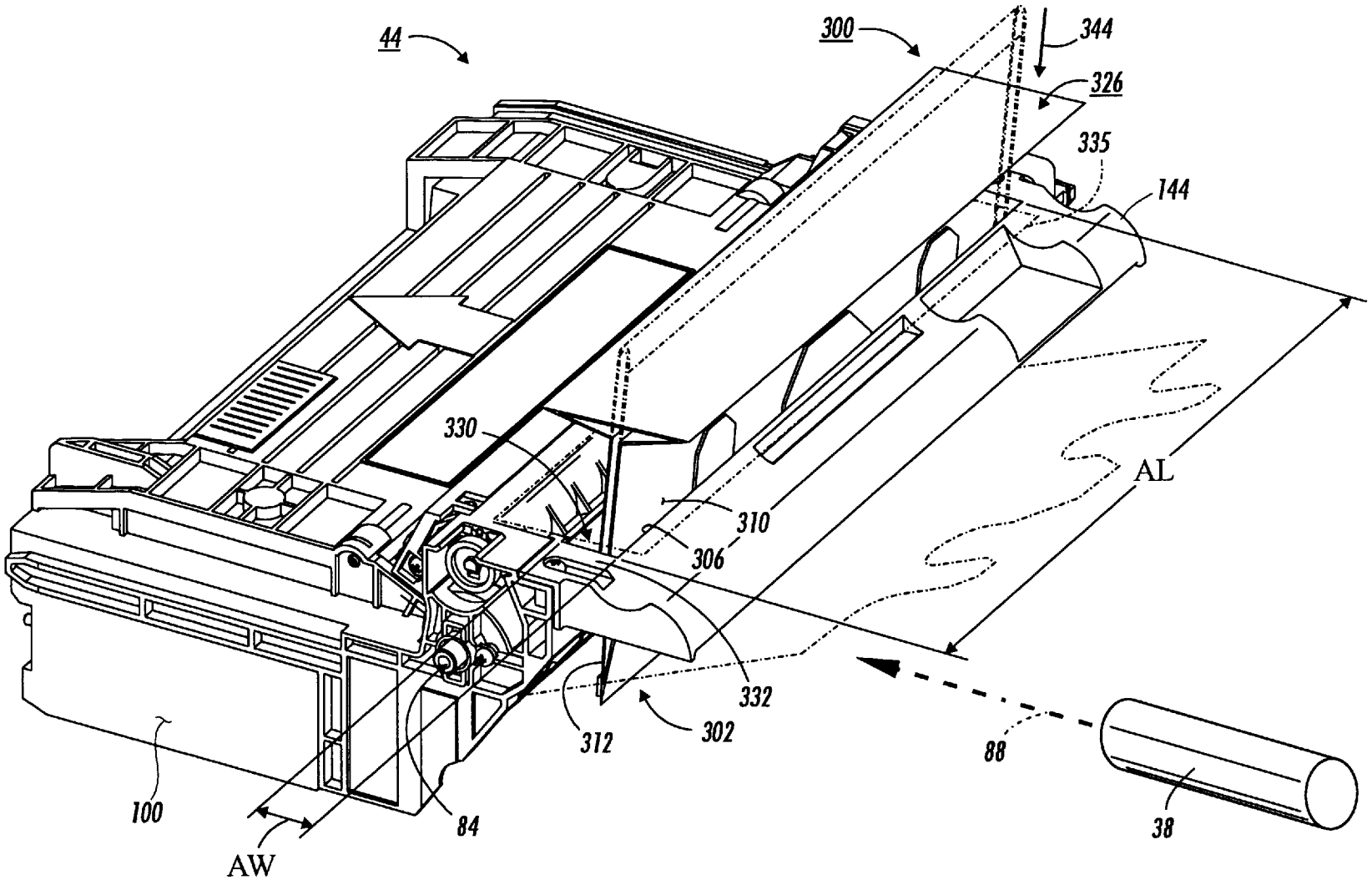
FIG. 8 is a perspective view of the CRU or process cartridge module of FIG. 2 showing the FIG. 1 cover in the process of installation into the cartridge module.

According to the present invention and referring to FIG. 8, a photoreceptor cover 300 according to the present invention is shown. The cover 300 is utilized to cover at least a significant portion of first aperture 302 formed in the housing 100. The first aperture 302 serves to permit exposed light 88 from the rastor output scanner 38 to be received onto the photoreceptor drum 84. The cover 300 serves to block the exposed light 88 coming from rastor output scanner 38.

Figure 9:
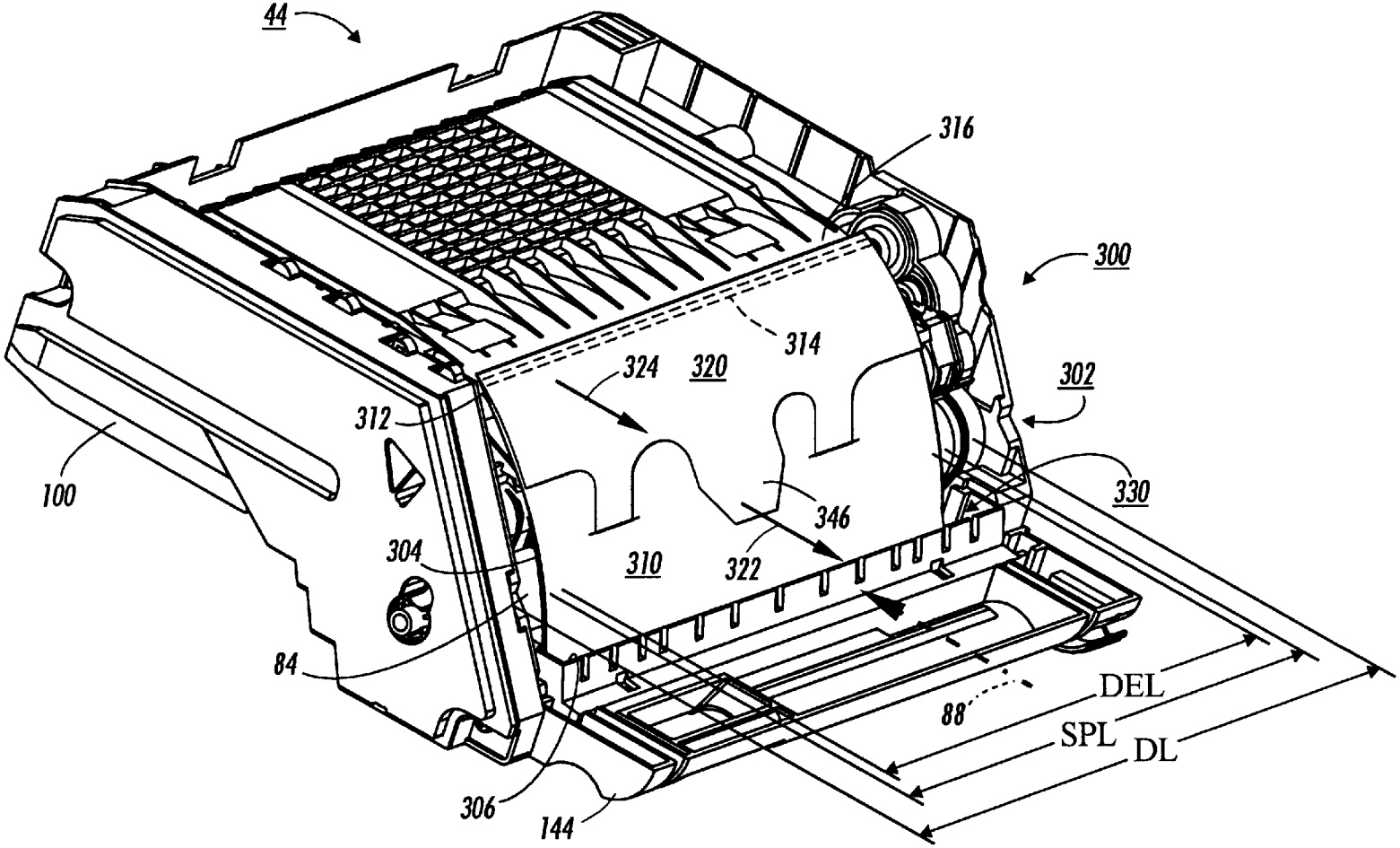
FIG. 9 is a perspective view of the CRU or process cartridge module of FIG. 2 showing the FIG. 1 cover installed into the cartridge module.

Referring now to FIG. 9, the cover 300 is shown in installed position on the housing 100 of the print cartridge 44. The cover 300 includes a first portion 304 which is positioned adjacent the housing 100 adjacent periphery 306 of the first aperture 302. The cover further includes a second portion 310 which may extend from first portion 304 as shown in FIG. 9. It should be appreciated, however, that an additional portion (not shown) of the cover 300 may be positioned between first portion 304 and second portion 310.

The second portion 310 is positioned between the exposed light 88 and the photoconductive drum 84. The second portion 310 has a second portion width SPL of a sufficient length such that a substantial portion of the photoreceptor drum length DL is covered by the second portion 310. The cover 300 may be configured with a second portion width SPL which is less than the length DL of the drum 84. This is particularly possible if the drum has a length DL which is greater than the width of the copy sheet to which it is associated. For example, the drum 84 may have an effective length DEL of less than the length DL of the drum. As long as the second portion length SPL is greater than the effective length DEL of the drum 84, the cover 300 may serve to protect the photoreceptive drum 84 from exposure. For example, for a print cartridge 44 utilizing media in the form of paper having a width of, for example, 8.5 inches, the second portion length SPL may be, for example, 9.25 inches.

The cover 300 further includes a third portion 312 which may extend from second portion 310 of the cover 300. It should be appreciated, however, that an additional portion (not shown) may be positioned between second portion 310 and third portion 312 of the cover 300. The third portion 312 is removably securable to the housing 100 of the print cartridge 44. The third portion 312 may be secured to the housing 100 by any suitable means, for example, by the use of fasteners, hooks or as shown in FIG. 9 by the use of an adhesive, for example, an adhesive strip 314 manufactured by Acme Company. The adhesive strip 314 is positioned between the third portion 312 and the housing 100 preferably, on portion 320 of the print cartridge where a flat uniform surface may be provide an adequate sealing surface.

The cover 300 further includes a fourth portion 320 which may extend from third portion 312. It should be appreciated, however, that the fourth portion 320 may be spaced from third portion 312 by an additional portion (not shown). The fourth portion 320 serves to assist in the removal of the cover after the print cartridge 44 is installed into the printing machine. As the fourth portion 320 is pulled in the direction of path 322, the third portion 312 including the adhesive strip 314 is directed along path 324 which is spaced a distance G from the photoreceptive drum 84. Thus, as the cover 300 is removed, the adhesive strip 314 on the third portion 312 does not come into close proximity with the drum 84 and thus the drum 84 is not so contaminated.

Referring again to FIG. 8, preferably, the cover 300 includes a resilient stop 326 positioned between first portion 304 and second portion 310. The resilient stop 326 serves to limit the travel of the cover 300 during the installation of the cover 300 onto the print cartridge 44.

As shown in FIG. 8, the print cartridge 44 may further include a member in the form of module handle 144. The handle 144 serves to assist in the loading and unloading of the print cartridge 44 into the printing machine. The handle 144 may also serve to guide the print media through the print cartridge 44. The handle 144 and the housing 100 define a second aperture 330 therebetween. The second aperture 330 provides a path for the print media when the print cartridge 44 is installed into the machine and is producing copies. The second aperture 330 further provides a guide for the cover 300 and provides a surface 332 onto which the resilient stop 326 rests during the installation position of the cover 300 onto the print cartridge 44. The cover 300 is preferably installed in a vertically downward direction as shown in arrow 334 of FIG. 8.

The cover 300 has a cover length CL which is less than aperture length AL of the second aperture 330 such that the cover 300 is insertable into the second aperture 330. For example, for a printing machine designed to print sheets with a width of, for example, 8.5 inches, the aperture may be, for example, 9.5 inches and the cover 300 may have a cover length CL of approximately 9.25 inches. During installation the first portion 304 and the second portion 310 of the cover 300 may be positioned against each other so that the first and second portions 304 and 310 of the cover 300 inserted into the second aperture 330.

The resilient stop 326 upon installation of the cover 300 rests against the surface 332 of the handle 144 as shown in phantom outline 335. The resilient stop 326 has a width CW which is substantially larger than the aperture width AW of the second aperture 330. For example, for a print cartridge 44 with an aperture width AW of, for example, 1.0 inches, the cover width CW may have a dimension of, for example, 1.4 inches.

Referring now to FIG. 1, the cover 300 is shown in greater detail. As shown in FIG. 1, the cover 300 preferably has a T-shape cross section. With the vertical part of the T including the first portion 304, the second portion 310 and the third portion 312. The top of the T includes the resilient stop 326. The first portion 304 is positioned adjacent the photoreceptor 84 and preferably includes a portion 336 which extends past and covers the first aperture 302.

The portion 336 serves at least two purposes. First, the extension portion 336 serves to provide additional blockage of the exposed light 88 from the rastor output scanner 38 (see FIG. 8). Also, the extension portion 336 serves to cover and protect the photoreceptor 86 as the adhesive strip 314 is removed with the cover 310 after installation of the print cartridge 44.

The resilient stop 326 preferably includes a top portion 340 and two side portions 342 and 344. The first side portion 342 is positioned between the first portion 304 and the top portion 340 while the second side portion 344 is positioned between the top portion 340 and the second portion 310 of the cover 300. The second portion 310 is positioned between the second side portion 344 of the first portion 340 and the third portion 312. The second portion 310 serves to block the photoconductive drum 84 from the exposed light 88. A third portion 312 of the cover 300 extends downwardly from second portion 310 and includes adhesive strip 314. Extending from the third portion 312 in a generally upward direction is fourth portion 320. The fourth portion 320 preferably includes a tab 346 for use in removing the cover 300.

The tab 346 preferably includes an identifier 350 in the form of an arrow, for example, green arrow 350 pointing in the direction of the tab pulling path 322. The arrow 350 serves to direct the user to the proper direction of removal of the cover 300. Preferably, when the cover 300 is installed, the arrow 350 is located in a position which is viewable by the operator positioned outside the printing machine.

To assist in maintaining the cover 300 in the generally T-shape, the third portion 312 preferably further includes support in the form of securing features 352, such as the protrusions shown in FIG. 1. The protrusions 352 are secured to the second portion 310 of the cover 300 by any suitable method, for example, by glue or fasteners or, preferably, as shown in FIG. 1, by slits 354 into which the protrusions 352 are fitted.

In order that the cover 300 may be removed easily from the print cartridge 44, the cover 300 preferably is constructed from a planar material, for example, a planar sheet. The cover 300 may be made of any suitable durable material which is capable of being positioned in a generally planar sheet. For example, the cover 300 may be made of a metal, a plastic or preferably from a paper material. The cover 300 may have a thickness T, for example, 0.08 inches. It should be appreciated that if the cover 300 is made of a metal or a plastic, the cover 300 should have a thickness less than if the cover 300 is made of paper. If made of paper, the cover 300 may be made from paper having a weight of 20 to 200 pounds. If made of plastic, the cover 300 is preferably made of a Mylar™ strip.

Figure 7:
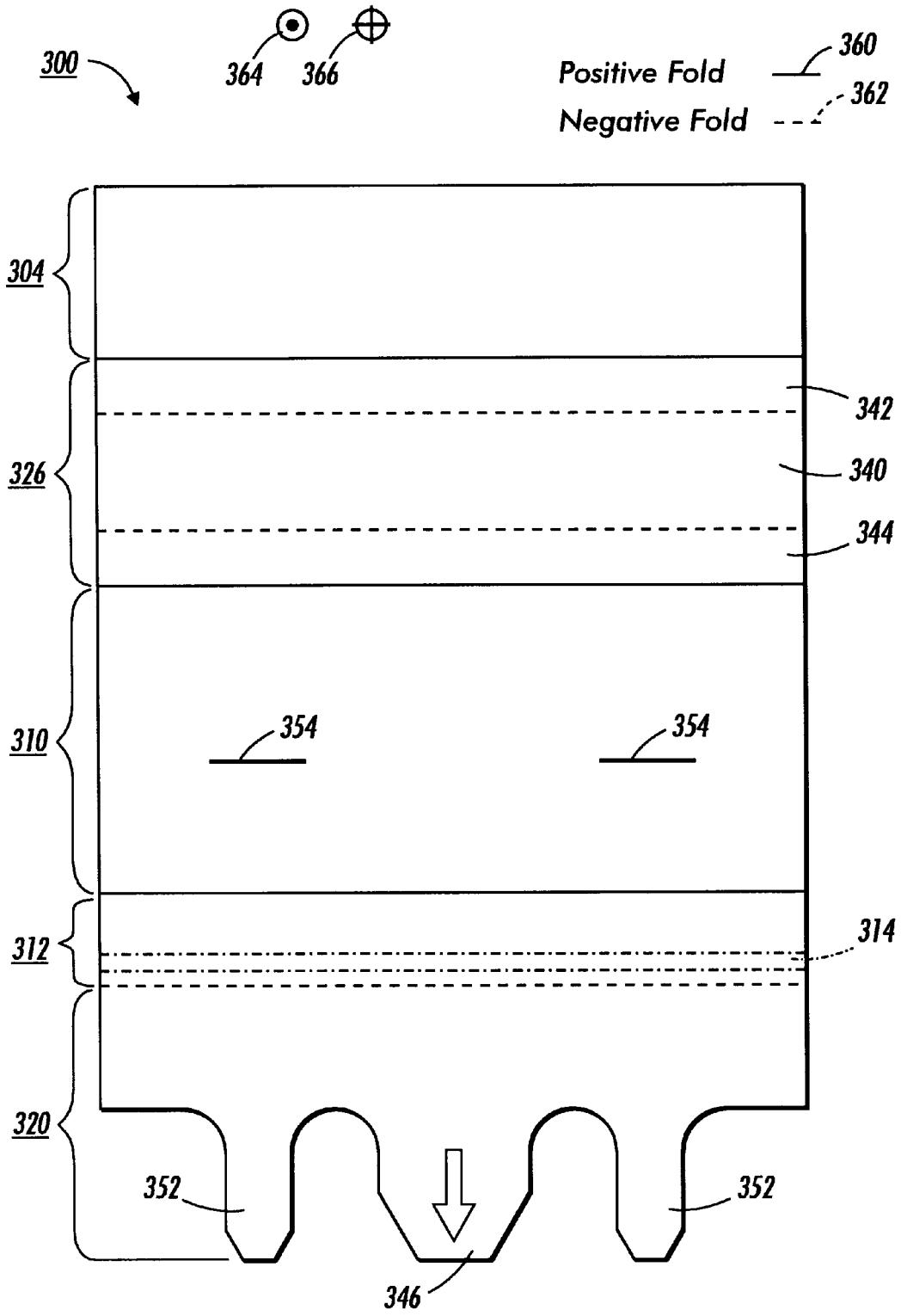
FIG. 7 is a top view of the photoreceptor cover of FIG. 1 in an unfolded condition.

As shown in FIG. 7, the strip 300 may be made from a planar sheet which is folded into the generally T-shape of FIG. 1. As shown from top to bottom, the cover 300 includes first portion 304 followed thereunder by resilient stop 326. The resilient stop 326 includes from top downwardly: first side portion 342, top portion 340 and second side portion 344. The second portion 310 is positioned below resilient stop 326 and third portion 312 is positioned below second portion 310. Fourth portion 320 is positioned below third portion 312. The tab 346 and the protrusions 352 extend below the fourth portion 320.

The cover 300 may be made by beginning with a planar sheet having a generally rectangular shape and which includes tab 346 and protrusions 352 formed thereon. The cover 300 is formed by folding the planar sheet into the generally T-shaped of FIG. 1.

For example, as shown in FIG. 7, the cover 300 is folded by a series of positive folds 360 and negative folds 362 as denoted by positive and dotted lines, respectively. The positive folds 360 are formed by moving the portions of the cover in a direction upward from the paper in the direction of arrow 364. The negative folds are formed by bending the portions adjacent the negative fold 362 in a direction downward from the paper in the direction of arrow 366.

Referring again to FIG. 9, the cover 300 is removed by pulling on tab 346 in the direction of tab path 322 until the adhesive strip 314 on the third portion 312 is separated from the housing 100. As the tab 346 is continued to move in the direction of arrow 322, the resilient stop 326 begins to deform at second aperture 330.

Referring now to FIG. 8, as additional force is applied to the stop 326 in the direction of arrow 334, the resilient stop 326 begins to fold with the portions 342 and 344 becoming deflected upwardly at the outer ends thereof so that the stop 326 is forced within the aperture 330. The removal force FR thus needs to be greater than the assembly force FA such that if the assembly force FA, for example, 0 to 2 pounds, the removal force FR needs to be greater than two pounds so that the resilient stop 326 may be collapsed inwardly into a position as shown in phantom outline 356.

By providing a photoreceptor cover that is removable after installation, the photoreceptive drum may be maintained in a clean, like new condition.

By providing a photoreceptor cover in which the cover is only glued along one longitudinal edge of the photoreceptor cover and in which the strip is removed in a direction away from the opening, removal of the cover may be had without contaminating the drum with the adhesive strip.

By providing a cover including a tab which is in full view when assembled into the printing machine, a simple easy removal of the cover may be provided.

By providing a T-shape folded cover strip, a simple inexpensive cover may be provided which is much less expensive than a complicated shutter mechanism.

By providing a photoreceptor cover which includes a portion thereof which is collapsible during disassembly, a cover may be had which is easily removable from a print cartridge without contaminating the photoconductive drum.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A cover for protecting from undesired exposure a photoconductive member assembled to the housing of a printing cartridge for use in a printing machine, the housing including an aperture periphery defining an aperture therein for communication of illumination from an illumination source with the photoconductive member, said cover comprising:

a first portion positionable adjacent said housing;

a second portion operably associated with said first portion and at least partially extendible between the illumination source and the photoconductive member for protecting a substantial portion of the photoconductive member from exposure;

a third portion operably associated with said second portion, said third portion removably securable to said housing; and a fourth portion operably associated with said third portion so that as said third portion is pulled from the housing said third portion is directed along a path spaced from the photoconductive member.

2. A cover according to claim 1, for use in a print cartridge having a member adjacent the first mentioned aperture, the member and the housing defining a second aperture therebetween, wherein at least a portion of said cover is insertable through the second aperture in the housing in a first direction, said cover being removable through the second aperture in the housing in the first direction.

3. A cover according to claim 1, wherein at least one of said first portion, said second portion, said third portion and said fourth portion are integral with another of said first portion, said second portion, said third portion and said fourth portion.

4. A cover according to claim 3, wherein at least two of said first portion, said second portion, said third portion and said fourth portion are formed from a planar sheet of material.

5. A cover according to claim 4, wherein said cover comprises paper.

6. A cover according to claim 4, wherein said planar sheet of material is cut and then folded into shape.

7. A cover according to claim 1, further comprising a resilient stop positioned between the first portion and the second portion, said resilient stop for limiting the travel of the cover in a first direction during installation of the cover with an installation force in the first direction and for permitting the travel of the cover with a removal force greater than said installation force in the first direction during removal of the cover.

8. A cover according to claim 7, the print cartridge having a member adjacent the first mentioned aperture, the member and the housing defining a second aperture therebetween;

wherein said resilient stop if formed by folding said cover into a substantially T shape when installed into the printing cartridge; and wherein at least a portion of said cover is insertable through the second aperture in the housing in a first direction, the resilient stop being blocked by the housing at the second aperture.

9. A cover according to claim 1, wherein said fourth portion comprises a tab.

10. A cover according to claim 9, further comprising a securing feature, said securing feature including a protrusion operably associated with third portion.

11. A printing cartridge for use in a printing machine for applying developer material onto a latent image formed by an illuminated source to form a developed image, said printing cartridge comprising:

a housing, defining an aperture therein;

a photoconductive member operably connected to the housing; and a cover for protecting from exposure said photoconductive member, said cover including a first portion positioned adjacent said housing, a second portion operably associated with said first portion and at least partially extended between the illumination source and the photoconductive member for protecting a substantial portion of the photoconductive member from exposure, a third portion operably associated with said second portion, said third portion removably secured to said housing and a fourth portion operably associated with said third portion so that as said third portion is pulled from the housing said third portion is directed along a path spaced from the photoconductive member.

12. A printing cartridge according to claim 11:

further comprising a member adjacent the first mentioned aperture, said member and said housing defining a second aperture therebetween; and wherein at least a portion of said cover is insertable through the second aperture in said housing in a first direction, said cover being removable through the second aperture in said housing in the first direction.

13. A printing cartridge according to claim 11, wherein at least one of said first portion, said second portion, said third portion and said fourth portion are integral with another of said first portion, said second portion, said third portion and said fourth portion.

14. A printing cartridge according to claim 13, wherein at least two of said first portion, said second portion, said third portion and said fourth portion are formed from a planar sheet of material.

15. A printing cartridge according to claim 14, wherein said cover comprises paper.

16. A printing cartridge according to claim 14, wherein said planar sheet of material is cut and then folded into shape.

17. A printing cartridge according to claim 11, wherein said cover further comprises a resilient stop positioned between said first portion and said second portion, said resilient stop for limiting the travel of said cover in a first direction during installation of said cover with an installation force in the first direction and for permitting the travel of said cover with a removal force greater than said installation force in the first direction during removal of said cover.

18. A printing cartridge according to claim 17:

further comprising a member adjacent the first mentioned aperture, said member and said housing defining a second aperture therebetween;

wherein said resilient stop is formed by folding said cover into a substantially T shape when installed into the printing cartridge; and wherein at least a portion of said cover is insertable through the second aperture in said housing in the first direction, the resilient stop being blocked by said housing at the second aperture.

19. A printing cartridge according to claim 11, wherein said fourth portion comprises a tab.

20. A printing cartridge according to claim 19, further comprising a securing feature, said securing feature including a protrusion operably associated with said third portion.

21. An electrophotographic printing machine of the type including a printing cartridge for applying developer material onto a latent image formed by an illuminated source to form a developed image, said printing cartridge comprising:

a housing, defining an aperture therein;

a photoconductive member operably connected to the housing; and a cover for protecting from exposure said photoconductive member, said cover including a first portion positioned adjacent said housing, a second portion operably associated with said first portion and at least partially extended between the illumination source and the photoconductive member for protecting a substantial portion of the photoconductive member from exposure, a third portion operably associated with said second portion, said third portion removably secured to said housing and a fourth portion operably associated with said third portion so that as said third portion is pulled from the housing said third portion is directed along a path spaced from the photoconductive member.

22. A printing machine according to claim 21:

further comprising a member adjacent the first mentioned aperture, said member and said housing defining a second aperture therebetween; and wherein at least a portion of said cover is insertable through the second aperture in said housing in a first direction, said cover being removable through the second aperture in said housing in the first direction.

23. A printing machine according to claim 21, wherein at least one of said first portion, said second portion, said third portion and said fourth portion are integral with another of said first portion, said second portion, said third portion and said fourth portion.

24. A printing machine according to claim 23, wherein at least two of said first portion, said second portion, said third portion and said fourth portion are formed from a planar sheet of material.

25. A printing machine according to claim 24, wherein said cover comprises paper.

26. A printing machine according to claim 24, wherein said planar sheet of material is cut and then folded into shape.

27. A printing machine according to claim 21, wherein said cover further comprises a resilient stop positioned between said first portion and said second portion, said resilient stop for limiting the travel of said cover in a first direction during installation of said cover with an installation force in the first direction and for permitting the travel of said cover with a removal force greater than said installation force in the first direction during removal of said cover.

28. A printing machine according to claim 27:

further comprising a member adjacent the first mentioned aperture, said member and said housing defining a second aperture therebetween;

wherein said resilient stop is formed by folding said cover into a substantially T shape when installed into the printing cartridge; and wherein at least a portion of said cover is insertable through the second aperture in said housing in the first direction, the resilient stop being blocked by said housing at the second aperture.

29. A printing machine according to claim 21, wherein said fourth portion comprises a tab.

30. A printing machine according to claim 29, further comprising a securing feature, said securing feature including a protrusion operably associated with said third portion.

* * * * *